US006971937B2

(12) United States Patent
Menken et al.

(10) Patent No.: US 6,971,937 B2
(45) Date of Patent: Dec. 6, 2005

(54) METHOD OF MANUFACTURING A SPARK PLUG FOR AN INTERNAL COMBUSTION ENGINE

(75) Inventors: Lars Menken, Donzdorf (DE); Bernd Reinsch, Ludwigsburg (DE); Klaus Hrastnik, Stuttgart (DE); Dietrich Trachte, Leonberg (DE); Klaus Czerwinski, Iggingen (DE)

(73) Assignee: Robert Bosch GmbH, Stuttgart (DE)

( * ) Notice: Subject to any disclaimer, the term of this patent is extended or adjusted under 35 U.S.C. 154(b) by 55 days.

(21) Appl. No.: 10/240,122

(22) PCT Filed: Feb. 6, 2001

(86) PCT No.: PCT/DE01/00452

§ 371 (c)(1),
(2), (4) Date: Nov. 13, 2002

(87) PCT Pub. No.: WO01/73907

PCT Pub. Date: Oct. 4, 2001

(65) Prior Publication Data

US 2003/0122461 A1 Jul. 3, 2003

(51) Int. Cl.[7] ..... H01T 21/02
(52) U.S. Cl. ..... 445/7; 313/141; 313/142
(58) Field of Search ..... 445/7; 313/141, 313/142, 144; 123/169 EL, 169 R

(56) References Cited

U.S. PATENT DOCUMENTS 4,540,910 A * 9/1985 Kondo et al. ..... 313/141
4,581,558 A * 4/1986 Takamura et al. ..... 313/141
4,743,793 A * 5/1988 Toya et al. ..... 313/141
5,101,135 A * 3/1992 Oshima ..... 313/142
6,262,522 B1 * 7/2001 Osamura et al. ..... 313/141

FOREIGN PATENT DOCUMENTS

| | | |
|---|---|---|
| DE | 196 50 728 A | 6/1997 |
| DE | 199 25 672 A | 12/1999 |
| EP | 0 505 368 B1 | 2/1996 |
| EP | 0 785 604 B1 | 6/1999 |

OTHER PUBLICATIONS

Patent Abstracts of Japan vol. 1996, No. 12, Dec. 26, 1996 & JP 08 222349 A, Aug. 30, 1996.

Patent Abstracts of Japanm, vol. 1996, No. 12, Dec. 26, 1996 & JP 08 222351, Aug. 30, 1996.

* cited by examiner

*Primary Examiner*—Nimeshkumar D. Patel
*Assistant Examiner*—Mariceli Santiago
(74) *Attorney, Agent, or Firm*—Michael J. Striker

(57) ABSTRACT

A spark plug for an internal combustion engine is proposed, having at least two electrodes (9, 11), one of which at least two electrodes is at least one middle electrode (11) and another electrode of the at least two electrodes is at least one ground electrode (9), and between the at least one ground electrode (9) and the at least one middle electrode (11), a spark gap (13) is formed. Each of the at least two electrodes (9, 11) has an electrode base body (93, 113). At least one electrode has a region (95, 115) that is highly resistant to electrode erosion and that forms at least a part of the end face, oriented toward the spark gap, of the electrode (97, 117). The highly electrode-erosion-resistant region (95, 115) comprises an alloy which has at least the elements iridium and nickel.

6 Claims, 2 Drawing Sheets

METHOD OF MANUFACTURING A SPARK PLUG FOR AN INTERNAL COMBUSTION ENGINE

BACKGROUND OF THE INVENTION

The invention is based on a spark plug for an internal combustion engine as generically defined by the preamble to the independent claim. A spark plug for an internal combustion engine is already known (European Patent Disclosure EP 0 785 604 B1) that has a middle electrode, the middle electrode comprising a middle electrode base body and a small noble metal plate as its highly electrode-erosion-resistant region. The small noble metal plate is secured to the end face, toward the combustion chamber, of the middle electrode base body. It is also known from EP 0 785 604 B1that small noble metal plates can be applied to the end face, toward the combustion chamber, of the middle electrode base body by laser welding or resistance welding. The small noble metal plate comprises a platinum alloy, iridium alloy, or platinum-based alloy, and the middle electrode base body comprises a nickel alloy.

From European Published, Nonexamined Patent Disclosure EP-OS 50 53 68, a spark plug middle electrode is known that is produced by extrusion. A middle electrode of this kind has a region of material that is highly resistant to electrode erosion, on the end toward the combustion chamber. This kind of highly electrode-erosion-resistant middle electrode region comprises platinum, for instance, or an alloy of platinum metals.

SUMMARY OF THE INVENTION

The spark plug of the invention having the characteristics of the independent claim has the advantage over the prior art that different coefficients of thermal expansion between the electrode base body and the highly electrode-erosion-resistant region and that comprises noble metal alloys are adapted. This decreases thermomechanical stresses at the transition between the highly electrode-erosion-resistant region and comprises noble metals and the electrode base body. The durability of the welded connection can thus be improved, and hence the service life of the spark plug can be lengthened. Moreover, by using nickel, material costs are reduced. In addition, the materials of the electrode base body and the highly electrode-erosion-resistant region, because of the addition of nickel, have a greater similarity in their physical properties, for instance in terms of the melting point, which leads to an improved joining of the materials in welding.

By the provisions recited in the dependent claims, advantageous refinements of and improvements to the spark plug defined by the main claim are possible. It is especially advantageous to select the composition of the highly electrode-erosion-resistant region such that the nickel content amounts to more than 10 atom-%, since only a significant proportion of nickel can perceptibly alter the coefficient of thermal expansion. It is also advantageous to use iridium-rhodium-nickel alloys as material for the highly electrode-erosion-resistant region, since the addition of nickel lowers the melting point and increases the ductility, making the material easier to process. Iridium-nickel-platinum alloys or iridium-nickel-rhodium alloys have better oxidation resistance than iridium-nickel alloys. It is also advantageous that in the direction of the spark gap, the highly electrode-erosion-resistant region protrudes past the end face toward the spark gap of the electrode base body, since the spark emerges from the region of the material. It is also advantageous that the highly electrode-erosion-resistant region has a height between 1 mm and 0.2 mm and a diameter of up to 2 mm. Thus the highly electrode-erosion-resistant region is the correct size to offer sufficient surface area for the emergence of the spark and for not extracting too much heat from the volume in which the spark is generated.

BRIEF DESCRIPTION OF THE DRAWINGS

Exemplary embodiments of the invention are shown in the drawings and explained in further detail in the ensuing description.

DETAILED DESCRIPTION OF THE PREFERRED EMBODIMENTS

Figure 1:
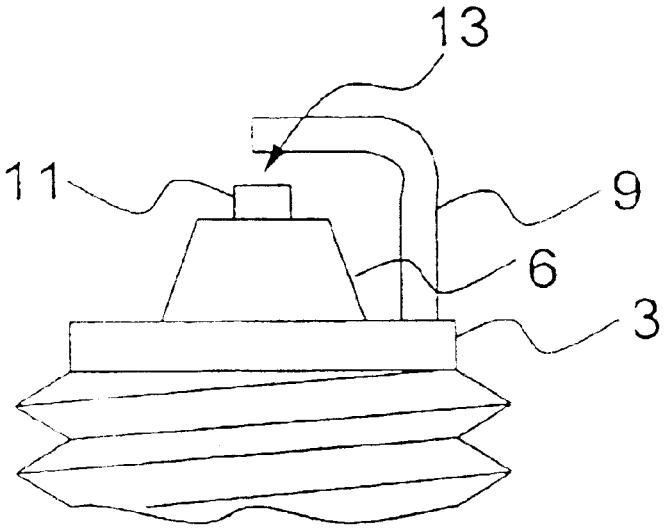
FIG. 1 shows a side view of an end, toward a combustion chamber, of a spark plug of the invention.

The basic layout and function of a spark plug is well known from the prior art and can be learned for instance from the Robert Bosch GmbH publication entitled "*Bosch-Technische Unterrichtung-Zündkerzen*" [Bosch Technical Instruction: Spark Plugs], 1985. FIG. 1 shows the end, toward the combustion chamber, of a spark plug schematically in a view from the side. The spark plug has a metal tubular housing 3, which is radially symmetrical. In a center bore along the axis of symmetry of the metal housing, an insulator 6 is disposed, extending coaxially. In a central bore extending along the longitudinal axis of the insulator, a middle electrode 11 is disposed on the end toward the combustion chamber; in this exemplary embodiment, the middle electrode protrudes from the bore on the end of the insulator toward the combustion chamber. In another exemplary embodiment, not shown, the middle electrode 11 can also be disposed such that it does not protrude from the bore of the insulator 6. On the end of the middle electrode remote from the combustion chamber, an electrically conductive glass melt, not shown, is disposed in the bore of the insulator 6; it connects the middle electrode to the connection bolt, also not shown, that is also disposed in the central bore of the insulator. One or more ground electrodes 9 are also disposed on the end toward the combustion chamber of the metal housing. The electrical energy that reaches the end of the combustion chamber of the spark plug via the connection bolt, the electrically conductive glass melt, and the middle electrode now causes a spark to flash over between the middle electrode and one or more ground electrodes; this ignites the fuel-air mixture in the combustion chamber.

The distance 13 with the shortest spacing between a point on the surface of the middle electrode 11 and a point on the surface of the ground electrode is known as the spark gap 13.

Figure 2:
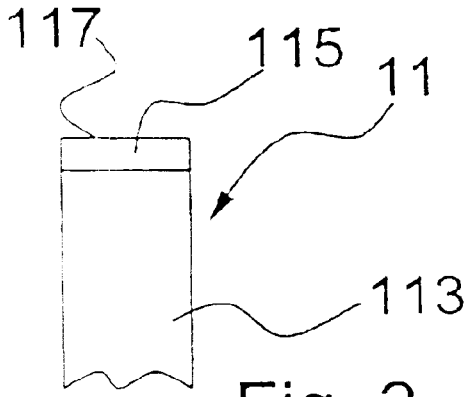
FIGS. 2–5 each show the end, toward the combustion chamber, of a middle electrode of a spark plug of the invention, schematically in cross section.

In FIG. 2, the end toward the combustion chamber of a middle electrode is shown schematically in cross section. The middle electrode has a middle electrode base body 113, and a highly electrode-erosion-resistant region 115 is disposed on the middle electrode base body 113, on the end toward the combustion chamber. The highly electrode-erosion-resistant region 115 of the middle electrode forms one end of the spark gap 13, so that the spark flashes over directly in the vicinity of the highly electrode-erosion-resistant region 115 of the middle electrode. The highly electrode-erosion-resistant region 115 of the middle electrode is distinguished by a high resistance to spark erosion and corrosion, thus assuring a long functional service of the spark plug. This highly electrode-erosion-resistant region 115 of the middle electrode has an end face 117 oriented toward the spark gap. The highly electrode-erosion-resistant region 115 of the middle electrode assures that corrosion or oxidation of the middle electrode 11 on the end toward the combustion chamber is minimized. The middle electrode base body 113 comprises nickel, or a nickel alloy, usually with a copper core.

The highly electrode-erosion-resistant region 115 of the middle electrode comprises an alloy having as its components iridium and nickel; the proportion of nickel is preferably greater than 10 atom-%; that is, $Ir_{100-x}Ni_x$, and preferably 10 atom-%<x.

In a further preferred exemplary embodiment, the element platinum is additionally selected as an alloy component of a highly electrode-erosion-resistant region 115 of the middle electrode; the composition is preferably selected as follows: $Ir_yNi_xPt_{100-y-x}$, in which 10 atom-%<x<30 atom-%, and 10 atom-%<y<30 atom-%. In a further preferred exemplary embodiment, the highly electrode-erosion-resistant region 115 of the middle electrode comprises an iridium-nickel-rhodium alloy, preferably with the following composition: $Ir_yNi_xRh_{100-y-x}$, in which 10 atom-%<x<30 atom-%, and 50 atom-%<y<80 atom-%.

Because of the preferably high nickel content of between 10 atom-% and 30 atom-%, it is assured that the coefficient of thermal expansion of the highly electrode-erosion-resistant region 115 of the middle electrode and the coefficient of thermal expansion of the middle electrode base body 113 are adapted to one another in such a way that during severe thermal stress, low mechanical stresses occur, and the service life of the middle electrode is thus lengthened. Also because of the high proportion of nickel, the highly electrode-erosion-resistant region 115 of the middle electrode is less expensive than a highly electrode-erosion-resistant region that comprises only noble metals. Moreover, iridium-nickel-platinum alloys and iridium-nickel-rhodium alloys have a better oxidation resistance than iridium-nickel alloys.

Figure 3:
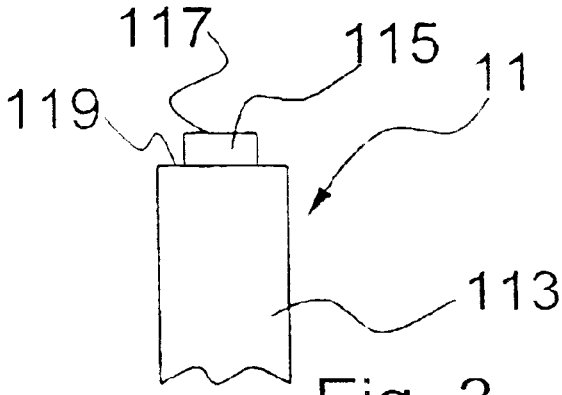

In FIG. 3, a further exemplary embodiment for the end, toward the combustion chamber, of a middle electrode is shown schematically in cross section. Once again, a highly electrode-erosion-resistant region 115 of the middle electrode is disposed on the end, toward the combustion chamber, of a middle electrode base body 113. At the transition from the middle electrode base body 113 to the highly electrode-erosion-resistant region 115 of the middle electrode, however, there is a shoulder, since the diameter of the end face 119, toward the spark gap, of the middle electrode base body 113 is greater than the diameter of the highly electrode-erosion-resistant region 115 of the middle electrode. The composition of the highly electrode-erosion-resistant region 115 of the middle electrode, and of the middle electrode base body 113, is selected analogously to the compositions described in conjunction with FIG. 2.

Figure 4:
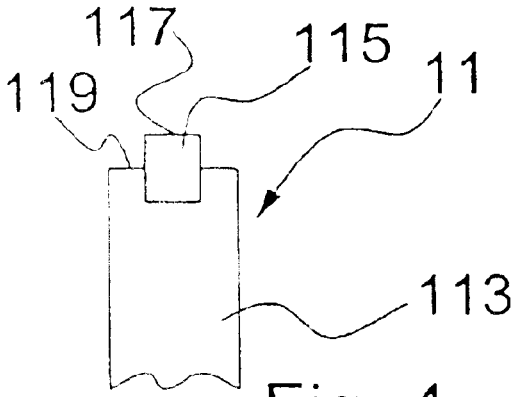
Figure 5:
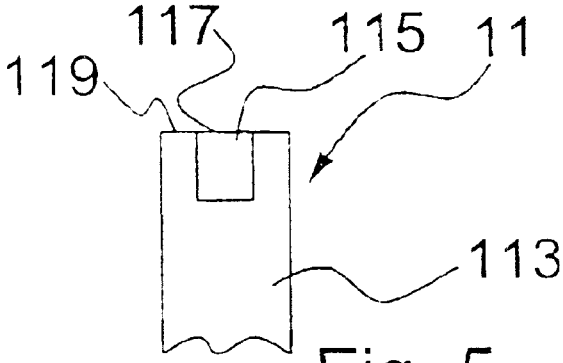

In FIG. 4, a further exemplary embodiment of a middle electrode for a spark plug of the invention is shown schematically in cross section. Unlike the middle electrode shown in FIG. 3, the highly electrode-erosion-resistant region 115 of the middle electrode now protrudes past the end face 119, toward the spark gap, of the middle electrode base body 113 and on into the middle electrode base body 113. In FIG. 5, which also shows a further exemplary embodiment for the middle electrode of a spark plug of the invention, the highly electrode-erosion-resistant region 115 of the middle electrode protrudes so far into the middle electrode base body 113 that the end face 117, toward the spark gap, of the highly electrode-erosion-resistant region 115 of the middle electrode forms a face with the end face 119, toward the spark gap, of the middle electrode base body 113.

Figure 6A:
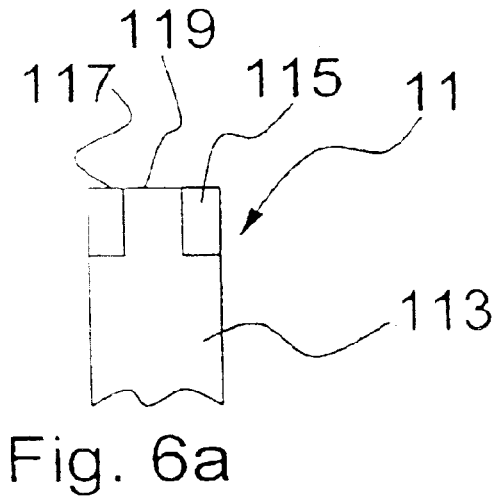
FIGS. 6*a* and 6*c* show the end, toward the combustion chamber, of a middle electrode of a spark plug of the invention, schematically in cross section.

In FIG. 6*a*, a further exemplary embodiment of a middle electrode 11 is shown schematically in cross section.

Figure 6B:
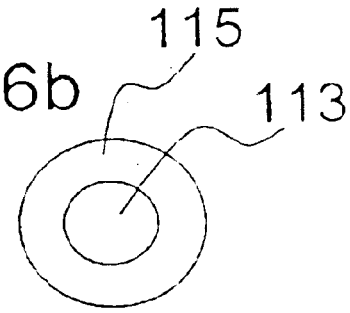
FIG. 6*b* shows the end, toward the combustion chamber, of the middle electrode shown in FIG. 6*a*, of a spark plug of the invention, schematically in a view from above.
Figure 6C:
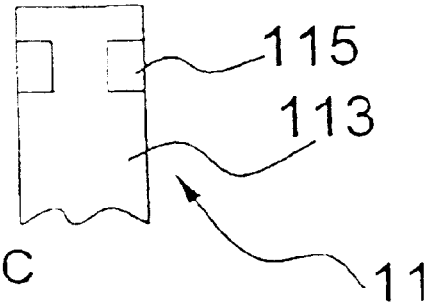
Figure 8:
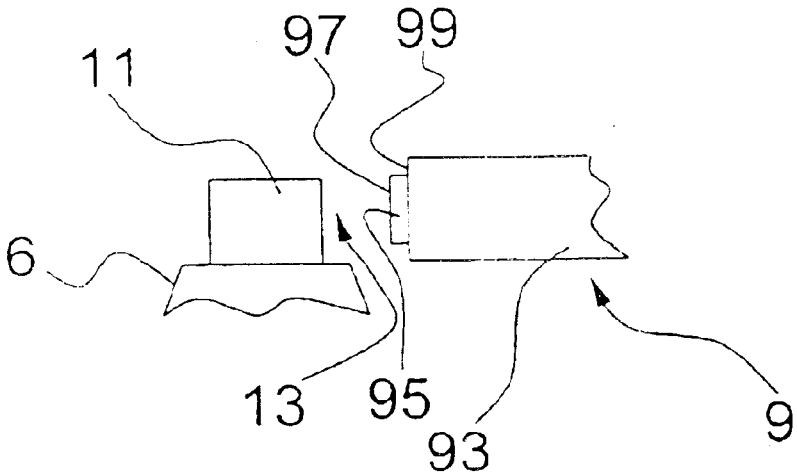
FIG. 8 shows the view of the end, toward the combustion chamber, of a middle electrode and a ground electrode of a spark plug of the invention, schematically from the side.

Here, the highly electrode-erosion-resistant region 115 is disposed such that it has a cylindrical shape; in an axial, cylindrical volume, the middle electrode base body 113 is extended as far as the end, toward the combustion chamber, of the middle electrode 11. The highly electrode-erosion-resistant region 115 accordingly forms a region on the circumference of the middle electrode 11, on the end toward the combustion chamber of the middle electrode 11. In the view of the middle electrode 11 from above, shown in FIG. 6*b*, the middle electrode base body 113 thus forms the middle circle, while the highly electrode-erosion-resistant region 115 forms the circular ring extending around the middle circle. This kind of disposition of the erosion-resistant region is advantageous above if the spark flashes over radially at the middle electrode 11, or in other words when the spark gap 13 extends such that the point in the surface of the middle electrode 11 that is part of the shortest connecting path between a point on the surface of the middle electrode 11 and a point on the surface of the ground electrode 9 is located on the circumferential surface, toward the combustion chamber, of the middle electrode. This kind of course of the spark gap 13 occurs for instance whenever the ground electrode 9, as shown in FIG. 8, is positioned laterally against the middle electrode 11. In another exemplary embodiment, the middle electrode is positioned laterally against the insulator 6, so that the spark slides across the end face, toward the combustion chamber, of the insulator toward the middle electrode 11. In a further exemplary embodiment, as shown schematically in cross section in FIG. 6*c*, the highly electrode-erosion-resistant region 115 is disposed, analogously to the embodiment shown in FIG. 6*a*, in such a way that it is not located directly on the end toward the combustion chamber of the middle electrode 11 but rather at a particular fixedly specified spacing from the end toward the combustion chamber of the middle electrode 11.

The middle electrodes 11 shown in FIGS. 4, 5 and 6 have the same composition as described in FIG. 2 in their highly electrode-erosion-resistant region 115 and in their middle electrode base body 113.

The middle electrodes shown in FIGS. 2–6, in a preferred exemplary embodiment, are produced in such a manner that the highly electrode-erosion-resistant region 115 of the middle electrode is applied to the end face, toward the combustion chamber, of the middle electrode base body 113 by laser or resistance welding. Even if the highly electrode-erosion-resistant region 115 of the middle electrode protrudes past the end face 119, toward the spark gap, of the middle electrode base body 113 into the middle electrode, the highly electrode-erosion-resistant region 115 of the middle electrode is still applied by welding, because an indentation in the middle electrode base body 113 is provided, in which indentation the highly electrode-erosion-resistant region 115 of the middle electrode is placed, before this region is welded. Analogously to the production of the middle electrode by means of welding, in a further exemplary embodiment the middle electrode is produced in that the highly electrode-erosion-resistant region 115 is applied to the middle electrode base body 113 by soldering.

In a further preferred exemplary embodiment, the middle electrode 11 is produced by extrusion; optionally, the end toward the combustion chamber of the extruded middle electrode is also machined by a metal-cutting machining method, so that at least a portion of the end face of the end, toward the combustion chamber, of the middle electrode is formed by the highly electrode-erosion-resistant region 115.

The middle electrodes described in conjunction with FIGS. 2–6 can also be of such a nature that the end, toward the combustion chamber, of the middle electrode base body 113 and/or of the highly electrode-erosion-resistant region 115 of the middle electrode extends conically.

Figure 7:
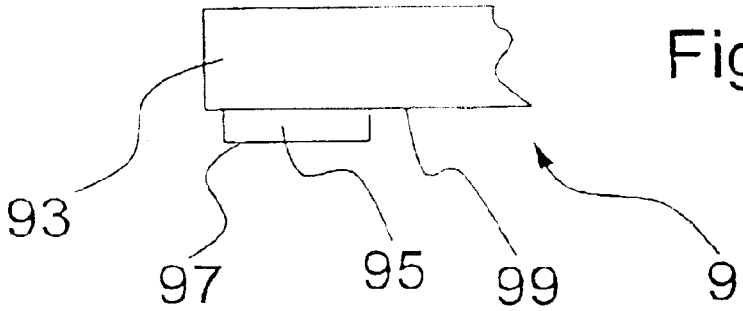
FIG. 7 shows the end, pointing in the direction of the spark gap, of a ground electrode of a spark plug of the invention, schematically in a view from the side.

In FIG. 7, a view from the side of a ground electrode 9 is shown schematically, on the end pointing in the direction of the spark gap. The ground electrode has a ground electrode base body 93, on which a highly electrode-erosion-resistant region 95 of the ground electrode is disposed in the direction of the spark gap. The highly electrode-erosion-resistant region 95 of the ground electrode, analogously to the highly electrode-erosion-resistant region 115 of the middle electrode, forms the face at which the spark flashes over. To that end, the highly electrode-erosion-resistant region 93 of the ground electrode likewise has high resistance to spark erosion and corrosion. The end face 97, pointing in the direction of the spark gap, of the highly electrode-erosion-resistant region 95 of the ground electrode has the largest surface area, in comparison with the other surface areas of the highly electrode-erosion-resistant region 95 of the ground electrode. The composition of the ground electrode base body 93 is equivalent to the composition explained in conjunction with FIG. 2 for the middle electrode base body 113. The composition of the highly electrode-erosion-resistant region 95 of the ground electrode is equivalent to one of the compositions of the highly electrode-erosion-resistant region 115 of the middle electrode that have been explained in conjunction with FIG. 2.

In FIG. 8, a further exemplary embodiment for a ground electrode of a spark plug of the invention is shown in a view from the side. Also schematically shown is a view from the side of an end, toward the combustion chamber, of a middle electrode 11 and of an insulator 6. In this exemplary embodiment, the highly electrode-erosion-resistant region 95 of the ground electrode is disposed on a different end face of the ground electrode, since because of the disposition of the ground electrode and the middle electrode relative to one another, the end face 99, pointing in the direction of the spark gap, of the ground electrode base body 93 is formed on a different surface. The composition of the highly electrode-erosion-resistant region 95 of the ground electrode is equivalent, in this exemplary embodiment as well, to one of the compositions of the highly electrode-erosion-resistant region 115 of the middle electrode that have been explained in conjunction with FIG. 2.

Analogously to the possibilities of embodying the highly electrode-erosion-resistant region 115 of the middle electrode, as explained in conjunction with FIGS. 2–6, here the highly electrode-erosion-resistant region 95 is produced on or applied to the ground electrode 9. The highly electrode-erosion-resistant region 95 of the ground electrode is applied to the plane surface 99 of the ground electrode, or is placed in an indentation on the end face located in the direction of the spark gap. In a further exemplary embodiment, the production of the ground electrode 9 is effected analogously to the middle electrode by means of laser or resistance welding, by means of soldering, or by means of extrusion. The ground electrode 9 can also have a conically tapering highly electrode-erosion-resistant region 95 of the ground electrode and/or of the ground electrode base body 93.

A highly electrode-erosion-resistant region can be disposed either on at least one ground electrode 9 or on the middle electrode 11, or it can be disposed on both at least one ground electrode 9 and the middle electrode 11.

What is claimed is:

1. A method for making a spark plug for an internal combustion engine, comprising the following steps:

providing at least two electrodes (9, 11), wherein a first one of said at least two electrodes is at least one middle electrode (11) and another electrode of the at least two electrodes is at least one ground electrode (9);

forming a spark gap (13) between the at least one ground electrode (9) and the at least one middle electrode (11), wherein each of the at least two electrodes (9, 11) has an electrode base body (93, 113), wherein at least one electrode has a region (95, 115) that is highly resistant to electrode erosion and that forms at least a part of an end face of the electrode (97, 117), oriented toward the spark gap, wherein the highly electrode-erosion-resistant region (95, 115) comprises an alloy which has at least the elements iridium, platinum and nickel; and directly bonding the highly electrode-erosion-resistant region to the electrode base body by laser welding, with no intermediate stress-releasing layer.

2. The method of claim 1, wherein the nickel component of the alloy that has the elements iridium, platinum, and nickel is greater than 10 atom-%.

3. The method of claim 1, wherein the alloy of the highly electrode-erosion-resistant region (95, 115) is an iridium-nickel-platinum alloy, which has a composition $Ir_yNi_xPt_{100-y-x}$, in which 10 atom-%<x <30 atom-%, and 10 atom-%<y<30 atom-%.

4. The method of claim 1, wherein at least a portion of the highly electrode-erosion-resistant region (95, 115) protrudes, in the direction of the spark gap, past the end face, toward the spark gap, of the electrode bass body (99, 119).

5. The method of claim 1, wherein the highly electrode-erosion-resistant region (95, 115) has a height of between 1 mm and 0.2 mm.

6. The method of claim 1, wherein the highly electrode-erosion-resistant region (95, 115) has a diameter of up to 2 mm.

* * * * *